US009957086B2

(12) United States Patent
Kerman et al.

(10) Patent No.: US 9,957,086 B2
(45) Date of Patent: May 1, 2018

(54) TUBE HEAD WITH INSERT FORMING A BARRIER

(71) Applicant: ALBEA SERVICES, Gennevilliers (FR)

(72) Inventors: Eric Kerman, Chalons en Champagne (FR); Thierry Maurice, Chalons en Champagne (FR); Jean-Claude Jammet, Amiens (FR); Etienne Hermant, Chalons en Champagne (FR); Jérôme Liard, Gennevilliers (FR)

(73) Assignee: ALBEA SERVICES, Gennevilliers (FR)

( * ) Notice: Subject to any disclaimer, the term of this patent is extended or adjusted under 35 U.S.C. 154(b) by 306 days.

(21) Appl. No.: 14/010,094

(22) Filed: Aug. 26, 2013

(65) Prior Publication Data

US 2014/0061146 A1 Mar. 6, 2014

(30) Foreign Application Priority Data

Aug. 28, 2012 (FR) ..... 12 58047

(51) Int. Cl.

| | |
|---|---|
| ***B65D 35/00*** | (2006.01) |
| ***B65D 35/14*** | (2006.01) |
| ***B65D 23/00*** | (2006.01) |
| ***B65D 35/10*** | (2006.01) |

(52) U.S. Cl.

CPC ..... *B65D 23/00* (2013.01); *B65D 35/10* (2013.01)

(58) Field of Classification Search

CPC ..... B65D 35/10; B65D 35/38; B65D 51/223

USPC ..... 215/40, 12.1; 222/107; 264/262; 428/36.91; 220/67

See application file for complete search history.

(56) References Cited

U.S. PATENT DOCUMENTS

| | | | | |
|---|---|---|---|---|
| 3,260,411 | A * | 7/1966 | Dobson | 222/107 |
| 4,792,061 | A * | 12/1988 | Nishida | B65D 35/12 222/107 |
| 2005/0029216 | A1* | 2/2005 | Scheifele | 215/12.1 |
| 2006/0065587 | A1* | 3/2006 | Shigesada et al. | 210/321.87 |
| 2012/0255972 | A1* | 10/2012 | Schneider | 222/107 |

FOREIGN PATENT DOCUMENTS

| | | |
|---|---|---|
| DE | 2005 005 166 | * 10/2006 |
| FR | 1445014 | 7/1966 |
| GB | 2022547 | 12/1979 |

* cited by examiner

*Primary Examiner* — Anthony Stashick
*Assistant Examiner* — Raven Collins
(74) *Attorney, Agent, or Firm* — Steven M. Greenberg, Esq.; CRGO Law

(57) ABSTRACT

A tube head is provided which is designed to be associated with a skirt so as to form an internal volume of the tube. The tube head includes a body formed from plastics material, that includes a neck having an opening at a first end, through which opening a product is removed from the internal volume of the tube, and a shoulder which is joined to a second end of the neck opposite the first end. The tube head also includes an insert arranged so as to be in contact with said shoulder and forming a barrier between the body and the product contained in the internal volume. The insert includes a central portion and a peripheral region. The central portion forms a non-perforated disc sealing the neck, and the peripheral region being mounted so as to as to be in contact with a complementary planar surface of the body.

14 Claims, 2 Drawing Sheets

TUBE HEAD WITH INSERT FORMING A BARRIER

CROSS REFERENCE TO RELATED APPLICATIONS

This application claims priority under 35 U.S.C. § 119(a) to French Patent Application Serial Number 1258047, filed Aug. 28, 2012, entitled "IMPROVED TUBE HEAD COMPRISING AN INSERT FORMING A BARRIER", the entire teachings of which are incorporated herein by reference.

BACKGROUND OF THE INVENTION

Field of the Invention

The present invention relates to the field of flexible tubes, and more specifically to the heads of such tubes.

Description of the Related Art

Flexible tubes commonly consist of a tube head associated with a skirt, the tube head comprising a neck for removing a product contained in the tube, while the skirt forms the internal volume of the tube which is designed to receive a product.

The skirt is conventionally formed from a multi-layered sheet which is designed to have satisfactory mechanical resistance and sealing properties.

The tube head is, however, commonly produced by plastics injection, and this may prove to be unsatisfactory for certain applications owing to the very aggressive nature of some products.

To solve this problem, a plurality of solutions have been proposed, particularly including a metal insert which fits to the inner face of the shoulder of the tube head so as to form a barrier which separates the tube head itself from the product contained in the tube and thus protects said tube head.

U.S. Pat. No. 3,260,411 to Egremont can be cited in particular and includes a flexible tube structure of this type comprising an insert which is arranged in the tube head and is shaped so as to fit to the profile of the shoulder of the tube head.

However, tube head structures of this type are complex and expensive to produce, the barrier properties of the insert are diminished owing to the significant plastic deformation to which it is subjected, and the prolonged periods of storage of the product may therefore lead to the tube head being broken down by the product.

BRIEF SUMMARY OF THE INVENTION

The present invention provides a structure which overcomes the above-mentioned drawbacks of the state of the art and provides for a novel and non-obvious tube head with an insert forming a barrier.

More particularly, the present invention proposes a tube head which is designed to be associated with a skirt so as to form an internal volume of the tube, said tube head comprising a body, which is made of plastics material, comprising a neck having an opening at a first end, through which opening a product is removed from the internal volume of the tube, and a shoulder which is joined to a second end of the neck opposite the first end, said tube head further comprising an insert arranged so as to be in contact with, more particularly so as to bear against, said shoulder so as to form a barrier between the body and the product contained in the internal volume, characterised in that said insert comprises a central portion and a peripheral region, said central portion forming a non-perforated disc which is designed to seal the neck, and said peripheral region being mounted so as to be in contact with, more particularly so as to bear against, a complementary surface of the body.

The invention thus makes it possible to provide a tube head comprising an insert which forms a barrier which thus protects the body of the tube head from the product which it contains, and also forms a film seal which separates the internal volume of the tube prior to its first use.

Said insert is formed, for example, from a multi-layered material comprising a metal barrier layer.

According to an aspect of the invention, said insert is arranged so as to be substantially perpendicular to a longitudinal axis of the neck. In other words, said insert is substantially planar. A feature of this type has the advantage of limiting stresses on an insert by shapes which are too sharply conical, that is to say have too narrow a point angle. Such shapes cause the insert to be worked during formation, and working of this type risks weakening said insert, particularly the metal barrier layer thereof.

"Substantially planar" means that said insert has a shape which may be strictly planar or at the least, in the case of a tube head having a rotationally symmetrical shape, is not larger than a cylindrical volume having a diameter D and a height h, a ratio of the value h/D being less than 0.1, preferably 0.08, more preferably 0.065, the diameter D corresponding to the diameter of the insert.

According to another embodiment, said insert comprises a disc made of aluminium or of ethylene vinyl alcohol.

According to yet another embodiment, the body further comprises an inner shoulder which holds the periphery of said insert against the complementary planar surface of the body.

According to yet another embodiment, said tube head further comprises a cap which is designed to be screwed to said neck, said cap comprising a punch which is designed to make a perforation in said insert to produce an opening in the insert, the opening having a cross-section which is less than or equal to the internal cross-section of the neck.

The invention also relates to an assembly comprising a tube head as defined above and a flexible skirt associated with said tube head so as to form an internal volume of the tube, said internal volume being separated from the neck by the insert.

BRIEF DESCRIPTION OF THE SEVERAL VIEWS OF THE DRAWINGS

Other features, objects and advantages of the invention will become clearer from the following description, which is given merely by way of example, is non-limiting and must be read with reference to the accompanying drawings, in which.

In all the figures, like elements are provided with like reference numerals.

DETAILED DESCRIPTION OF THE INVENTION

Figure 1:
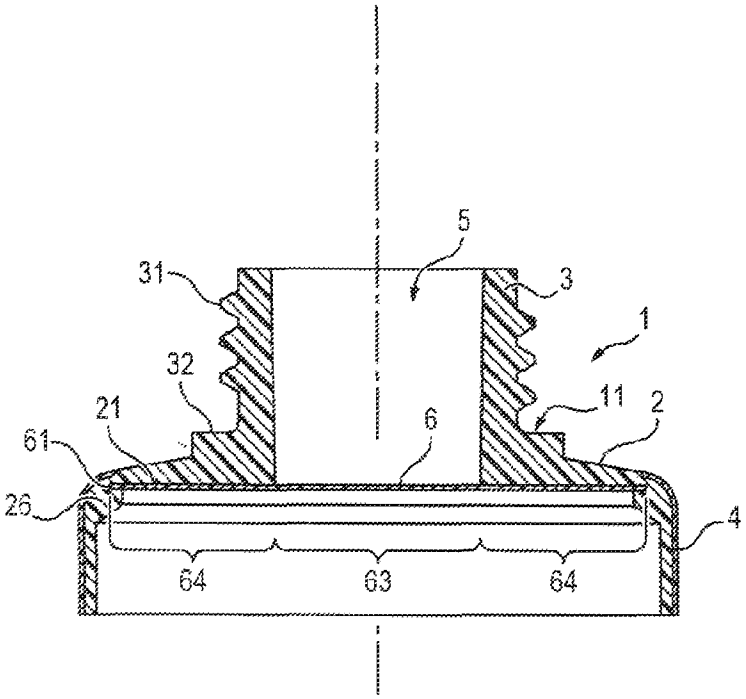
FIG. 1 is a cross-sectional view of a tube head according to an aspect of the invention.

FIG. 1 is a cross-sectional view of a tube head 1 according to an aspect of the invention.

The tube head 1 comprises a body 11 comprising a shoulder 2 and a neck 3 connected to the shoulder 2.

The shoulder 2 is connected to a skirt 4 which forms the body of the associated tube and thus defines an internal volume of the tube.

The neck 3 defines an internal passage 5 which is used for distributing a product contained in the internal volume of the tube. In the embodiment shown, the neck 3 comprises an external thread 31 which makes it possible for a cap to be screwed onto said neck 3, and a bearing surface 32 which can function as a stop for a cap of this type.

The tube head 1 is connected to the skirt 4, typically by overmolding the tube head 1 on the skirt 1, or for example by welding or bonding when joining the skirt 4 to the tube head 1 formed previously, more particularly by injection molding or by compression injection molding, or by any other technique.

The skirt 4 is typically made of plastics material and/or of laminated metal, for example a multi-layered assembly comprising one or more layers of metal material such as aluminum and one or more layers of plastics material.

The tube head 1 further comprises an insert 6 arranged so as to be in contact with, more particularly so as to bear on, the shoulder 2, typically in contact with, more particularly bearing against, a surface 21 of the shoulder 2 oriented towards the internal volume of the tube defined by the skirt 4. The insert 6 is thus arranged in direct contact with the surface 21 of the shoulder 2, said contacting being produced by overmolding the body 11 of the tube head 1 on the insert 6 which in particular makes it possible to fix the insert 6 to the body 11 of the tube head 1.

Said surface 21 of the shoulder 2 thus defines a planar bearing surface for receiving the insert 6.

The insert 6 according to an aspect of the invention comprises a central portion 63 and a peripheral region 64, the central portion 63 forming a non-perforated disc which is designed to seal the neck 3 of the tube head 1, and the peripheral region 64 typically being frustoconical, planar or a combination of one or more frustoconical and/or planar portions extending from said central portion 63.

Figure 3:
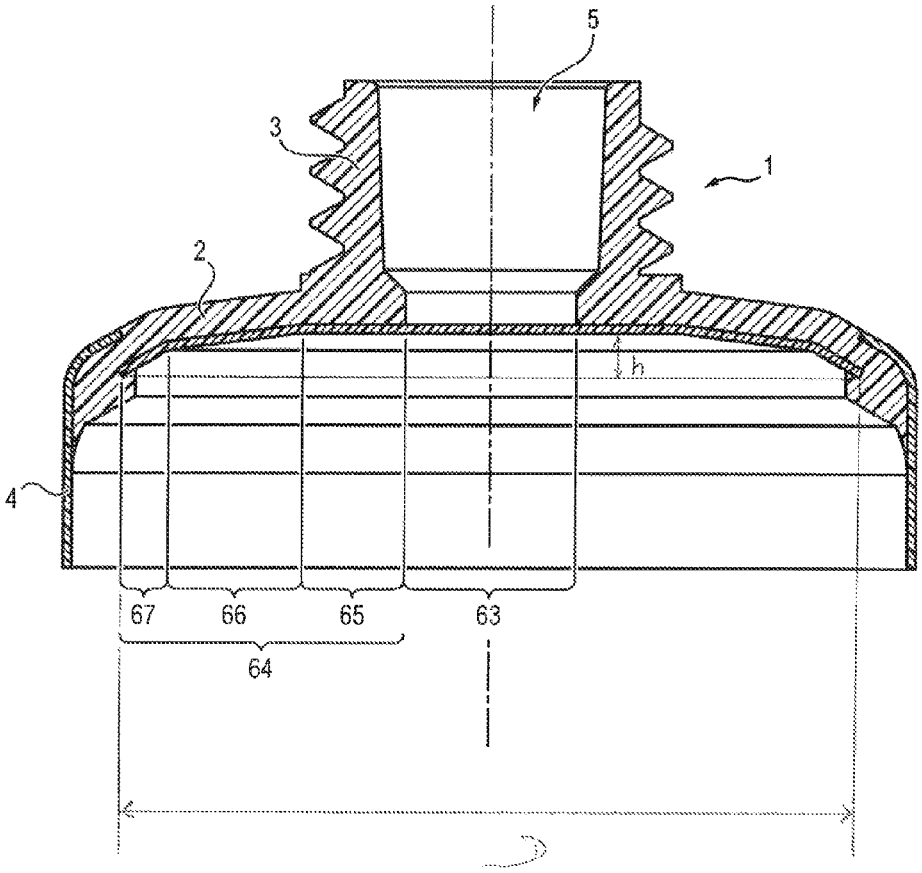
FIG. 3 shows another embodiment of a tube head according to an aspect of the invention.

Advantageously, the insert is substantially planar. By way of example, for a tube head which is rotationally symmetrical, it is within a cylindrical volume of diameter D and height h, a ratio of the value h/D being less than 0.1, preferably 0.08, more preferably 0.065, the diameter D corresponding to the diameter of the insert, as shown in FIG. 3, in which the height h to be taken into account has also been indicated.

In other words, even if the insert has one or more frustoconical portions, it has a point angle which is sufficiently wide, more particularly greater than 80°, even 85°.

Figure 2:
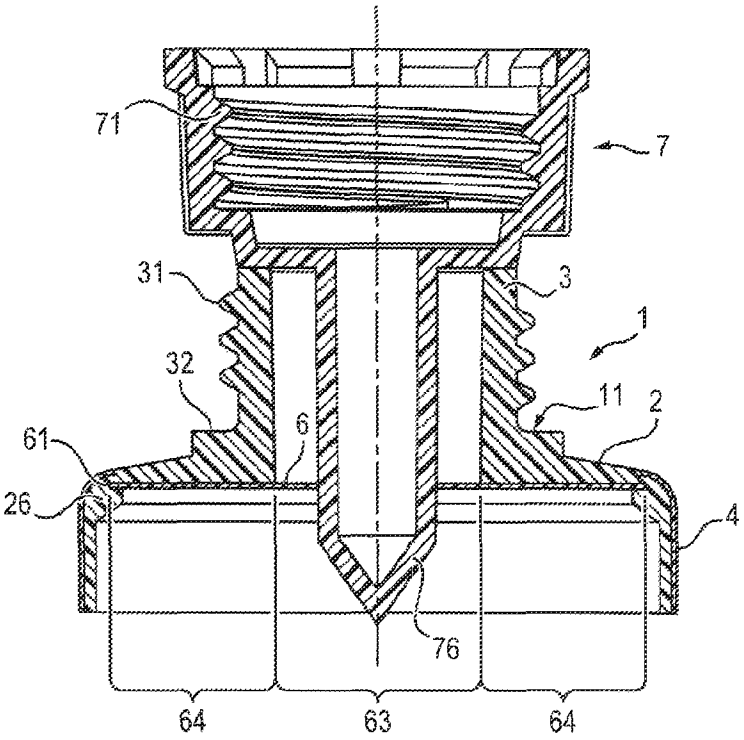
FIG. 2 is a cross-sectional view of the tube head shown in FIG. 1 and associated with a perforating cap.

The tube head as shown is typically associated with a perforating cap, for example of the type shown in FIG. 2.

The perforating cap 7 as shown is reversible; it has a first end provided with an internal thread 71 which is designed to cooperate with the external thread 31 of the neck 3 and thus to screw the perforating cap 7 to the tube head 1, and a second end provided with a punch 76 which is designed to be inserted into the neck 3 and to perforate all or part of the insert 6, and more specifically all or part of the central portion 63 thereof which seals the neck 3.

In the cross-section shown in FIG. 2, it can be seen that the punch 76 is dimensioned such that when the perforating cap 7 bears against the neck 3, the perforating end of the punch 76 goes beyond the position of the insert 6 in the tube head 1 and can perforate it, thus making it possible for the user to produce an opening which allows the internal volume of the tube and the internal passage 5 of the neck to communicate in order for the product contained in the internal volume to be dispensed.

The insert 6, and more particularly the central portion 63 thereof, thus forms a film seal which seals the internal volume of the tube defined by the skirt 4 and protects the product contained in said volume.

In the embodiment shown in FIGS. 1 and 2, the insert is planar-disc-shaped and therefore does not require plastic deformation steps, which would reduce the mechanical properties thereof and more particularly the mechanical properties of metal layers of the insert, and in particular the properties thereof which make it possible for said insert to perform the function of a barrier.

FIG. 3 shows another embodiment of a tube head according to aspect of the invention, in which the geometry of the peripheral section 64 is made up of the association between a planar section 65 and two successive frustoconical sections 66 and 67. In a variant, the external section 67 may be formed from a bent edge which ends substantially axially over a short length, typically less than 1 mm, even 0.5 mm As in the embodiment shown in FIGS. 1 and 2, the peripheral section 64 is mounted so as to be in contact with, more particularly so as to bear against, a complementary surface of the body 11, while the central portion 63 forms a film seal which is designed to seal the neck 3 of the tube head 1 prior to its first use, during which said central portion is perforated at least in part by a punch 76 as set out above.

The angle between the planar central portion 63 and the most inclined section of the peripheral section 64, in this case the section 67, is typically between 0 and 30°, for example between 10 and 30° or equal to 30°, making it possible to simplify the injection for forming the tube head. Alternatively or in addition, the angle between the planar section 65 and the adjacent frustoconical section 66 is, for example, between 0 and 15°, more particularly between 5 and 10°.

Within this range of values, the mechanical properties of the insert, in particular the mechanical properties of metal layers of the insert and more particularly the properties thereof which make it possible for said insert to perform the function of a barrier are not affected. The insert is only subject to low plastic deformation and the rupture of the metal layer is attained.

The product contained in the tube is thus protected in a lasting and efficient manner during the storage period thereof prior to use, and this storage period typically represents the majority of the lifetime of the tube.

In addition, the fact that the insert 6 is solid and does not have a machined central aperture makes it possible to overcome the drawbacks of centering which necessarily arise during the production of two concentric successive pierced holes. It is complex and expensive to perfectly centre the cutting of the outer periphery of the insert 6 relative to a central pierced hole of the disc thus formed.

Finally, in the case of a multi-layered insert 6 comprising an intermediate metal layer, the fact that the insert 6 is only perforated when it is first opened makes it possible to protect the intermediate metal layer thereof which is thus not exposed to the product contained in the tube during storage. An example of the structure of the insert 6 is a polyethylene-aluminium-polyethylene-type multi-layered insert.

Inserts 6 which are commonly used for producing a bather function in heads of flexible tubes are typically made up of two plastics material layers surrounding an intermediate metal layer.

The two layers of plastics material serve to separate the metal layer from the product contained in the tube, which is likely to oxidize said metal layer.

Therefore, it is understood that only the edges of the insert 6 expose the intermediate metal layer thereof.

To the extent that the insert 6 is a solid disc prior to perforation, only the outer peripheral edge 61 thereof exposes the intermediate metal layer of said insert.

The shoulder 2 of the tube head 1 is advantageously overmolded on the insert 6 so as to cover the outer peripheral edge 61 of the insert 6, for example by forming an inner shoulder 26 which holds the periphery of said insert 6 against the complementary planar surface of the body 11 and thus protects the intermediate metal layer of the insert 6 prior to perforation.

It is understood that the perforation of the insert 6 by the punch 76 forms an inner peripheral edge of the insert, by means of which edge the intermediate metal layer is exposed. However, taking into account the lifetime of a tube of this type after it is first used, the risk of the insert 6 degrading after perforation is negligible.

The shelf life of a tube in which the insert is not perforated, corresponding for example to the storage, handling and transport thereof, is conventionally far greater than the shelf life thereof after it is first used.

The protection of the insert 6 prior to the first use of the associated tube and thus prior to the perforation of the insert 6 is therefore a significant factor for preserving the product contained in the tube, and this makes it possible to carry out the present invention.

The invention makes it possible to produce a sealed and cost-effective tube head, since the following problems are solved:

the cutting of the central aperture of the insert 6 which requires a high degree of cutting precision such that this central aperture is concentric with the outer peripheral edge 61;

the protection of the edge of the central aperture of the insert 6, and more particularly the metal layer, against the product contained in the tube;

the reduction of the barrier properties of the insert 6 owing to the shape of the insert, which is substantially planar, at the least in the region of the central section 63 thereof, which is a critical region for protecting the product contained in the associated tube.

What is claimed is:

1. A tube head configured for association with a skirt so as to form an internal volume of the tube, said tube head comprising:

a body, formed from a plastics material, comprising a neck having an opening at a first end, through which opening a product is removed from the internal volume of the tube, and a shoulder which is joined to a second end of the neck opposite the first end; and an insert arranged so as to be in contact with said shoulder so as to form a barrier between the body and the product contained in the internal volume, said insert comprising a central portion and a peripheral region, said central portion forming a non-perforated disc sealing the neck, and said peripheral region being mounted so as to be in contact with a complementary planar surface of the body, the insert being substantially planar and within a cylindrical volume of diameter D and height h, a ratio of the value h/D being less than 0.1.

2. The tube head according to claim 1, wherein said insert is arranged substantially perpendicular to a longitudinal axis of the neck.

3. The tube head according to claim 1, wherein said insert comprises a disc formed from either aluminium or ethylene vinyl alcohol.

4. The tube head according to claim 1, wherein the body further comprises an inner shoulder holding the peripheral region of said insert against the complementary planar surface of the body.

5. The tube head according to claim 1, further comprising a cap adapted to be screwed to said neck, said cap comprising a punch configured to perforate said insert to produce an opening in the insert, the opening having a cross-section which is less than or equal to an internal cross-section of the neck.

6. An assembly comprising:

a tube head comprising:

a body, formed from a plastics material, comprising a neck having an opening at a first end, through which opening a product is removed from the internal volume of the tube, and a shoulder which is joined to a second end of the neck opposite the first end;

an insert arranged so as to be in contact with said shoulder so as to form a barrier between the body and the product contained in the internal volume, said insert comprising a central portion and a peripheral region, said central portion forming a non-perforated disc sealing the neck, and said peripheral region being mounted so as to be in contact with a complementary planar surface of the body, the insert being substantially planar and within a cylindrical volume of diameter D and height h, a ratio of the value h/D being less than 0.1; and a flexible skirt associated with said tube head so as to form an internal volume of the tube, said internal volume being separated from the neck by the insert.

7. The assembly according to claim 6, wherein said insert is arranged substantially perpendicular to a longitudinal axis of the neck.

8. The assembly according to claim 6, wherein said insert comprises a disc formed from either aluminium or ethylene vinyl alcohol.

9. The assembly according to claim 6, wherein the body further comprises an inner shoulder holding the peripheral region of said insert against the complementary planar surface of the body.

10. The assembly according to claim 6, further comprising a cap adapted to be screwed to said neck, said cap comprising a punch configured to perforate said insert to produce an opening in the insert, the opening having a cross-section which is less than or equal to an internal cross-section of the neck.

11. The tube head according to claim 1, wherein the ratio h/D is less than 0.08.

12. The tube head according to claim 1, wherein the ratio h/D is less than 0.065.

13. The assembly according to claim 6, wherein the ratio h/D is less than 0.08.

14. The assembly according to claim 6, wherein the ratio h/D is less than 0.065.

* * * * *